US008871035B2

(12) United States Patent
Fortunati et al.

(10) Patent No.: US 8,871,035 B2
(45) Date of Patent: Oct. 28, 2014

(54) PROCESS FOR THE PRODUCTION OF GRAIN-ORIENTED MAGNETIC SHEET STARTING FROM THIN SLAB

(75) Inventors: Stefano Fortunati, Rome (IT); Giuseppe Abbruzzese, Rome (IT); Stefano Cicale', Rome (IT)

(73) Assignee: Centro Sviluppo Materiali S.p.A., Rome (IT)

( * ) Notice: Subject to any disclaimer, the term of this patent is extended or adjusted under 35 U.S.C. 154(b) by 103 days.

(21) Appl. No.: 13/129,827

(22) PCT Filed: Nov. 18, 2009

(86) PCT No.: PCT/EP2009/065382

§ 371 (c)(1), (2), (4) Date: Aug. 11, 2011

(87) PCT Pub. No.: WO2010/057913

PCT Pub. Date: May 27, 2010

(65) Prior Publication Data

US 2012/0018049 A1 Jan. 26, 2012

(30) Foreign Application Priority Data

Nov. 18, 2008 (IT) ..... RM2008A0617

(51) Int. Cl.

| | |
|---|---|
| ***C21D 8/12*** | (2006.01) |
| ***C22C 38/16*** | (2006.01) |
| ***C22C 38/00*** | (2006.01) |
| ***C22C 38/02*** | (2006.01) |
| ***C22C 38/04*** | (2006.01) |
| ***C21D 6/00*** | (2006.01) |
| ***C21D 9/46*** | (2006.01) |

(52) U.S. Cl.

CPC ..... *C21D 8/1211* (2013.01); *C22C 38/16* (2013.01); *C22C 38/008* (2013.01); *C21D 2201/05* (2013.01); *C21D 8/1222* (2013.01); *C22C 38/02* (2013.01); *C22C 38/04* (2013.01); *C22C 38/001* (2013.01); *C21D 6/008* (2013.01); *C21D 8/1272* (2013.01); *C21D 8/1255* (2013.01); *C21D 9/46* (2013.01)

USPC ..... 148/208; 148/504; 148/306; 148/226

(58) Field of Classification Search

CPC ... C21D 2201/05; C21D 6/008; C21D 8/1211

USPC ..... 148/208, 504, 226, 306, 111–113

See application file for complete search history.

(56) References Cited

U.S. PATENT DOCUMENTS

| | | | | | |
|---|---|---|---|---|---|
| 5,667,598 | A * | 9/1997 | Ozaki et al. | ..... | 148/111 |
| 5,759,294 | A * | 6/1998 | Bolling et al. | ..... | 148/111 |
| 2010/0300583 | A1 * | 12/2010 | Abbruzzese et al. | ..... | 148/208 |

FOREIGN PATENT DOCUMENTS

| | | | |
|---|---|---|---|
| EP | 0393508 | A1 | 10/1990 |
| EP | 0732413 | A1 | 9/1996 |
| EP | 0922119 | A1 | 6/1999 |
| EP | 0925376 | A1 | 6/1999 |
| JP | 60056021 | A | 4/1985 |
| JP | 62010213 | A | 1/1987 |
| JP | 3229822 | A | 10/1991 |
| JP | 06257797 | * | 7/1995 |
| WO | WO 9808987 | A1 | 3/1998 |
| WO | WO 9810104 | A1 | 3/1998 |
| WO | WO 9846802 | A1 | 10/1998 |
| WO | WO 9848062 | A1 | 10/1998 |
| WO | WO 0250314 | A2 | 6/2002 |
| WO | WO 0250315 | A2 | 6/2002 |
| WO | WO 0250318 | A1 | 6/2002 |

OTHER PUBLICATIONS

Abstract to JP 070171610 (published on Jul. 1995).*

* cited by examiner

*Primary Examiner* — Jie Yang

(74) *Attorney, Agent, or Firm* — Browdy and Neimark, PLLC

(57) ABSTRACT

A process for producing grain oriented magnetic sheets by subjecting a steel slab ≤100 mm, containing 2.5-3.5% si, to the following operations: optional first heating, to a temperature T1≤1250° C.; first rough hot-rolling at T2 between 900 and 1200° C., the reduction ratio (% Rid) being at least 80% in the absence of a subsequent heating or, in the presence of a subsequent heating to T3≤1300° C., at least 60% determined by % Rid=80−(T3−T2)/5; second finishing hot-rolling at T4<1300° C. to a rolled-section thickness of 1.5 3.0 mm; cold-rolling, in one or more stages with optional intermediate annealing and with a cold reduction ratio ≥60% applied in the last stage; primary recrystallization annealing, optionally in a decarburizing atmosphere; second recrystallization annealing.

4 Claims, No Drawings

PROCESS FOR THE PRODUCTION OF GRAIN-ORIENTED MAGNETIC SHEET STARTING FROM THIN SLAB

The present invention relates to the production of magnetic sheets containing Silicon for electric applications having a high level of anisotropy and excellent magnetic characteristics along the strips' rolling direction, sheets known as Grain-Oriented magnetic sheets.

Grain-Oriented magnetic sheets can be applied in particular for constructing the cores of electrical transformers used in the whole cycle for producing and delivering electric energy (from the production plant as far as the final users).

As it is known, the magnetic characteristics qualifying these materials are the magnetic permeability along the reference direction (magnetization curve in the rolled sections' rolling direction) and the power losses, mainly dissipated under the heat form, due to the application of an alternating electromagnetic field (50 Hz in Europe) in the same reference direction wherein the magnetic flow flows and at the transformer operating inductions (typically the power losses at 1.5 and 1.7 Tesla are measured). The Grain-Oriented sheets produced industrially and existing on the market have different quality degrees. The best degrees are produced with very thin thickness (the power losses are directly proportional to the thickness of the rolled sections) and have excellent magnetic permeability, by applying a magnetic field of 800 ampere-turn/meter inductions $B_{800}$>1.8 Tesla are obtained and for the best products up to $B_{800}$>1.9 Tesla.

The excellent magnetic properties obtainable with these products are strictly determined, apart from the chemical composition of the alloy (Si>3%—the Silicon increases the electric resistivity and therefore reduces the magnetic losses) and from the thickness of the rolled sections (magnetic losses directly proportional to the thickness of the rolled sections), from the characteristic microstructure constituting the polycrystalline metal matrix of the finished products. In particular, the metal matrix of the finished sheets has to include the smaller possible amount of elements such as Carbon, Nitrogen, Sulphur, Oxygen able to form small inclusions (second phases) interacting with the motion of the walls of the magnetic domains during the magnetization cycles by increasing the losses, and the orientation of the individual metal crystals has to result with the reticular direction <100> (according to the Miller indexes) corresponding to the reticular direction of the ferritic crystals easier to be magnetized, aligned as much as possible to the rolling direction.

The best industrial products have an extremely specialized crystalline texture (statistic distribution of the individual crystals orientations) with an angular dispersion of the <100> directions of the individual crystals with respect to the rolling direction comprised in an angular cone of 3°-4°. Such crystalline texture specialization level is proximate to the limits which can be theoretically obtained in a polycrystalline. Additional reductions of the above-mentioned angular dispersion cone can be obtained by reducing the crystals' density in the matrix and by consequently increasing the grains' average size. This, by balancing the functional characteristics of the product, even if by improving the permeability characteristic of the magnetic field in the reference direction, involves an increase in the power losses due to the higher influence of the so-called anomalous dynamic magnetic losses, well known to the persons skilled in the art, which result to be as higher as the size of the crystalline grains of the metal matrix is larger. Furthermore, upon increasing the crystalline grains' size, the mechanical properties of the products worsen (increase in brittleness).

Even if the transformers' manufacturers have available products high levels of quality and with excellent magnetic properties typical of the best degrees of Grain-Oriented (HGO—High permeability Grain-Oriented) sheet, in most cases, for manufacturing cores of the electric machines, they utilize classes of Grain-Oriented (CGO—Conventional Grain-Oriented) sheet of inferior quality, but with lower costs.

Therefore, the need is felt for the iron and steel industry to develop new methods for producing these products, therewith it is possible reducing the production costs of the degrees with excellent magnetic properties, by simplifying the production cycles and by increasing the physical and magnetic yields.

During the last years processes for the production of these products have been developed with technologies which solidify the Fe—Si alloy in cast products with a thickness nearer to the thickness of the final product (from thin slab to strip casting (as described in WO9848062, WO9808987, WO9810104, WO0250318, WO0250314, WO0250315) with advantages in the rationalization of the cycles and the reduction of the manufacturing costs.

The manufacturing of the grain-oriented sheets is based upon the preparation of a Fe—Si alloy which is solidified under the form of an ingot, slab or directly strip to produce however hot strips with a thickness typically comprised between 1.5-3.5 mm of alloy composition characterized by a Silicon content greater than 3% (but lower than 4% due to the increase in the mechanical brittleness associated to the Silicon contents and which drastically influences the industrial workability of the semi-finished products and finished products), and by the content rigorously calibrated in strict forks composing some elements necessary to generate a distribution of particles of second phases (sulphides, selenides, nitrides, . . . ) which in the last moment of the production process (thermal treatment of the rolled strip with final thickness) must guarantee a breaking action of the motion of the grains' edges of the metal matrix after primary recrystallisation. The thickness of the hot rolled sections is reduced to values typically comprised between 0.50 mm and 0.18 mm by means of cold-rolling. The special texture is strictly linked to the structure and texture generated by the cold deformation of the hot strips, it starts to develop with the thermal treatment which allows the primary recrystallisation and it completes by applying a static annealing of the strips to a very high temperature (up to 1200° C.) during thereof the particles of second phases slow down the grain growth until stagnating between 800° C. and 900° C. in order then to allow (when the second phases start dissolving and/or reducing in number) the selective and abnormal growth of some grains existing in matrix with crystallographic orientation proximate to [110] <001> (according to Miller), known as Goss grains. In order to limit to the minimum the presence of inclusions in the finished products (deleterious for the magnetic properties), the alloy carbon is reduced to contents lower than 30 ppm by means of decarburisation before the final annealing, whereas sulphur and nitrogen are eliminated during the final annealing for the complete de-sulphuration and de-nitriding with dry hydrogen at high temperature after completing the selective abnormal growth (oriented secondary recrystallisation).

What above described highlights the great complexity of the production process involving very long periods of time to produce the strips starting from the alloy in the melting furnaces and the implementation of several process phases on different plants. This strongly affects the step of fixing the cost of the finished products. Furthermore, the cycle complexity, the numerosity of the process elementary phases and the high sensibility of the products' final quality to the process parameters (chemical composition, process temperature, annealing atmosphere composition, etc. . . . ) lead to relatively low (physical and quality) process yields with respect to other iron and steel products.

Since the first patents claiming processes for the industrial manufacturing of grain-oriented sheets (Goss 1930), several techniques, process strategies and technologies have been proposed which have accompanied the development of the quality of the obtainable products and of the manufacturing cycles with significant cost reduction and yield increase.

However, in the field of the production technologies based upon thin slab casting, some important process and metallurgic constraints are found, described hereinafter, which are intrinsically connected to the reduced thickness of the cast slab defining the technology itself.

The thin slab casting technology produces a solidified product with a thickness comprised between 50 and 100 mm, against typical thicknesses of the slabs produced in conventional continuous casts no smaller than 200-250 mm. The thickness <100 mm is a critical limit to determine the solidification speed and casting speed conditions which, respectively, represent the metallurgic (solidification structure, segregation level, second phase precipitation) and productivity (tons/hour) opportunities of the technology.

The solidification structure, even if with smaller grain sizes with respect to the conventional casting, however remains the typical slab structure with an equiaxic/columnar fraction of 0.20-0.3 typical for these products also of the slab with conventional thickness. The size of the solidification crystals and the relationship between equiaxic and columnar structures of the slabs influences the grain structure and the texture of the hot rolled sections, with particular consideration to the presence of deformed and not recrystallised grains which elongate in the rolling direction (grains refractory to recrystallisation). In this sense a relative increase in the grain fraction with equiaxic structure in the solidified metal matrix involves microstructure advantages to obtain finished products with excellent characteristics and good yields in particular for a greater homogeneity of the grains' size in the hot rolled section.

The tendency of the columnar solidification grains to lengthen and not to recrystallise is due to the large size thereof and to the crystalline orientation thereof (direction <100> parallel to the normal to slab surface—deriving from the selective growth in solidification of grains which are oriented with the crystallographic direction easier for the heat extraction parallel to the direction of the thermal gradient induced by the cooling). For reasons linked to the lattice symmetries, a high fraction of these so-oriented grains is also under conditions of easy sliding during the hot-rolling down to strip shape and for this reason they statistically accumulate inside thereof a relatively low deformation energy (density of dislocations) also due to the dynamical "recovery" processes activated by the high temperature of the process.

Previous patent documents describe a method increasing the relationship between equiaxic and columnar solidification grains by using a series of process and plant parameters there among the implementation of an overheating temperature upon casting lower than 30° C. (WO9848062, WO9808987). Such a method has the contraindication that the casting parameters, there among the overheating temperature, influence the solidification structure in quite strict operative intervals, proximate to limits implementable for an industrial process and depending from the chemical composition. This makes critical the method implementation and too variable the microstructure of the hot strips in an industrial production therefore it is not possible keeping, for example, the overheating temperature (temperature difference between casting temperature and the solidification one) equal as from the beginning to the end of the casting and between casting and casting. For this reason, a stable industrial production based upon this strategy is difficult to be implemented and however it is complex and expensive for the rigorous control process required in the step of sending to casting and casting itself.

The thin thickness imposes the use of heating/equalization furnaces of the cast slabs sufficiently long to contain the slabs.

For this reason heating furnaces of pushing type or with walking beams are not used and tunnel-type furnaces must be adopted, therewith also advantageous continuous type process solutions are possible, until the casting processes and hot-rolling of "endless" type (hot-rolling of the cast product seamless connected until cutting the hot strips at the winding reels). However, such solutions limit the treatment times allowed before rolling and for the reasons connected to the motion mechanics of the cast product in the tunnel furnace (transportation rollers) limit the possible maximum treatment temperatures. Moreover, at high temperatures, there is the problem of handling the liquid or semi-solid slag forming onto the surface of the cast product during treatment which consequently lead to surface defect problems induced by the contact between slab surface and transportation rollers in the tunnel furnace. For these reasons the treatment maximum temperatures of the Fe—Si alloys in the heating furnaces of the thin slabs are industrially limited to maximum values of 1200-1250° C.

All this limits critically the possible content of alloy (micro alloy) elements which can be used for the precipitation in fine and homogeneously distributed form of the not metallic inclusions (second phases) necessary to control the grain growth (inhibitors of the grain growth) in the subsequent phases of the production process.

In WO9846802 and WO9848062 processes for manufacturing Grain-Oriented sheets are described which use the thin slab technology, the control of the content in Mn, S, (S+Se), Cu, Al, N and other elements potentially involved in the preparation of the distribution of grain growth inhibitors in forks defined so as to guarantee, within the implementable heating conditions, the dissolution of the fraction precipitated during the cast product cooling and the precipitation of sulphides and nitrides in fine form during and/or after the hot-rolling phase.

EP0922119 and EP0925376 describe the use of other chemical compositions and subsequent transformation cycles therewith it is possible to obtain industrially quality products and with good yields, also by adopting solid state nitriding techniques to increase the volumetric fraction of the grain growth inhibitors before the oriented secondary recrystallisation.

The various proposed solutions show specific shrewdness to obtain, within the constraints of maximum temperature implementable for heating/homogenizing the cast product in thin slab before the hot-rolling, the quantity and distribution of the grain growth inhibitors necessary to control the oriented secondary recrystallisation to obtain products with excellent magnetic characteristics, so as to guarantee a grain growth "Inhibition" (distribution of not metallic second phases) existing homogeneously in matrix before the secondary recrystallisation at least equal or greater than "1300 $cm^{-1}$" expressed with a technical fact or proportional to the whole surface of the second phase particles in matrix which can interact with the grain edge surface, known as Iz (Inhibition) and expressed by the following relationship:

$$Iz(\mathrm{cm}^{-1}) = \frac{6i}{\pi} * \frac{fv}{\bar{r}}$$

wherein fv is the volumetric fraction of second phases and $\bar{r}$ is the average value of the size of the existing second phases (expressed as spherical equivalent radius).

The mentioned reference value (greater than 1300 $\mathrm{cm}^{-1}$) is known as the one necessary to control the grain growth of the typical polycrystalline structures deriving from the primary recrystallisation after cold-rolling with the product final thickness. Such requirement is necessary to the correct development of the oriented secondary recrystallisation which takes place during the final annealing in the bell furnaces. The metallurgic requirement relates more precisely to the fact that the inhibition existing during the last thermal treatment of grain growth must be able to balance the tendency to grow (driving force) of the distribution of the primary crystallization grains so as to reach a "stagnation" transitory condition of the grain growth which is then released in a selective way during the course of the thermal treatment.

The growth "driving force" associated to the crystalline grain of primary recrystallization expresses with the parameter "DF" according to the following relation:

$$DF = \frac{1}{\phi} - \frac{1}{\phi_{max}}$$

Wherein $\phi$ represents the grain average size expressed in cm and $\phi max$ the distribution biggest grains' class size still expressed in cm (for both of them it commonly relates to values of spherical equivalent radius respectively of the average and of the class of the biggest grains).

In absence of anomalous non-homogeneities $\phi max$ is linked to the variance of the grains' size distribution and it can be assessed by means of the relation:

$$\phi max = \phi + n\sigma_{\phi}$$

Wherein $\sigma_{\phi}$ represents the standard deviation of the grains' size distribution and "n" a multiplying factor which, based upon statistical measurements on grain distributions made on cold-rolled and recrystallised Fe3% Si tests, can be approximated to 3 (three).

Based upon this piece of information, independently from the absolute values, it results that upon increasing the size non-homogeneity of the grains' distribution after primary recrystallisation, it is necessary that in the metal matrix there is a distribution of inclusions (second phases) in order to obtain a gradually higher inhibition to the grain growth to guarantee a correct oriented secondary recrystallisation and therefore to obtain the wished magnetic characteristics on the finished products.

An alternative strategy for obtaining primary recrystallisation homogeneous structures on industrial strips is to increase the cold reduction ratio so as to generate in the deformed structure high densities of dislocations homogeneously distributed in the matrix also in presence of heterogeneous starting structures. Such strategy, however, involves the need for increasing proportionally the hot strip thickness (the product reference final thickness being considered fixed) with a proportional cost increase for the cold-rolling and reduction in the physical yields (number of ruptures in cold-rolling proportionally higher than in case of higher reduction ratios). Moreover, upon increasing the applied cold reduction ratio, the cores of primary recrystallisation increase proportionally and consequently the recrystallisation grain size reduces. This involves an increase in the "driving force" of the grain growth (as deducible from the lz relation) consequently requesting the management of higher Inhibition values of the grain growth for controlling the final quality of the products.

Furthermore, by using the cold-rolling process, it is possible recovering micro-structural homogeneity by implementing cold-rolling in several stages alternated by intermediate annealing, even if with a transformation cost increase.

The authors of the present invention have performed a study about the possibility of reducing the micro-structural heterogeneity of the recrystallised cold rolled sections, produced during the manufacturing of grain oriented sheets and, in particular, they have studied the problem of the influence of the poor recrystallisation of the hot rolled sections in case of the manufacturing processes starting from thin slab casting.

In this case, in fact, due to the limited thickness of the cast slab, the deformation work available to modify the solidification crystalline structure is significantly lower with respect to the case of the hot-rolling of the conventional continuous casting processes (50-100 mm→2.5 mm against 200-250 mm→2.5 mm). In case of the thin slab processes, this involves a critical tendency to generate a poor recrystallised hot strips which, after cold-rolling and primary recrystallisation, have size distributions of the crystalline grain with high variance and thus "driving force" to the growth (and therefore the need for having a higher inhibition to control the final quality of the products) and/or with matrix localized areas with grains with significantly larger size than the average. In this latter case, on the finished products there could be observed groupings of very small secondary recrystallisation grains, and with different orientation from Goss, known to the persons skilled in the art as "streaks" and which represent a very dangerous defect for the magnetic quality of the products.

In case of processes conventionally operating outside the hot-rolling conditions prescribed in the present patent document, it is not possible generating the inhibitor volumetric fraction necessary to correctly control the grain growth after primary recrystallisation, as, even if taking into account the less segregation of the elements constituting the inhibitors (Mn,S,Al,N) obtainable with the thin slab casting, the thermodynamic solubility thereof practically constraints the maximum available amount thereof (below 1200° C.-1250° C., maximum temperatures practically implementable to heat the thin slabs in an industrial plant). The authors of the present invention have experimentally checked this chemical-physical constraint and found a solution to the problem of controlling the working equilibrium between driving force of the grain growth (DF parameter) and inhibition to the existing grain growth (lz parameter) with operating procedures which reduce the driving force to the grain growth after primary recrystallisation.

The present invention describes then a cycle for producing oriented-grain sheet joining the productivity (t/h), process (adoption of direct rolling and endless processes) and microstructural quality (reduced segregation of critical elements, finer precipitation of the second phases and reduction in the fraction of second phases precipitated before the hot-rolling due to the slab non-cooling, finer solidification grain structure) advantages associated to the thin slab technologies, with microstructure advantages deriving from the adoption of hot-rolling definite operating conditions which allow, on one side, to produce strongly recrystallised hot strips, by solving the problem of the reduced hot deformation work available with the thin slab and, on the other side, to obtain a grain structure of the annealed cold rolled sections, the correct evolution thereof in the subsequent process phases is effectively controlled by a smaller amount of growth inhibitors (lz) with respect to the conventional one the generation thereof is perfectly compatible with slab heating low temperatures.

In other words, the present invention intends to solve the problem existing in the industrial production of Grain Oriented Electrical Steel grades adopting the technique to solidify the melt Silicon-Iron alloy in the form of Thin Slab (thin slab continuous casting technology). The problem is related to the fact that in case of thin slab (slab thickness not larger than 100 mm) the total amount of hot rolling deformation to achieve the final thickness of hot rolled is much less than in case of the conventional continuous casting technique (slab thickness typically about 200-300 mm).

Such a lower amount of deformation of the hot rolling in case of thin slab technology is one of the advantageous characteristics related to its industrial adoption for the production of hot rolling coils, among these claimed advantages there is the possible avoidance of the roughing step, and consequently the roughing mill, to perform the hot rolling of the slabs. In fact, the thickness of the thin slab is actually comparable with the typical thickness of the "bars" which exits from the "roughing mill" to be sent to the entrance of the "finishing mill" in conventional rolling technology.

In case of slab thickness not larger than 100 mm (which is the case of thin slab casting technology) and when the Silicon content of the alloy is larger than 2.5% a stable and reliable control of the microstructure evolution of the strips along the production cycle is not possible, due to the resulting critical non-homogeneity of the microstructure of the deformed material, mainly grain structure and grains size through the thickness and in different portion of the strip. This results in unstable and poor magnetic properties on the final products The authors have found that the main reason for the existence of this problem is the level of deformation work during hot rolling which is much less than in the case of conventional continuous casting.

The present invention refers to way to perform the hot rolling of Silicon-Iron slabs, for the production of Grain Oriented Electrical Steels, casted by a continuous thin slab casting machine. The claimed hot rolling procedure is a two stages hot rolling performed by two distinct rolling mills, where the first stage is a "roughing rolling" performed by a "Rougher Mill" which transform the "casted slab" in "roughed bar". During this first thickness reduction when performed under the prescribed temperature range of 900-1200° C., the Silicon-Iron alloy under processing experiences a strong plastic deformation which produces a very high and equally distributed density of lattice defects up to a threshold limit with associated a proportional level of stored free energy. Such a level of deformation energy constitutes the "driving force" for the recrystallization of the deformed metallic matrix. In the fixed temperature range, the larger is lattice defects density the higher and homogeneous is the recrystallization fraction in the metallic matrix before the second rolling stage. A short permanence at about the same temperature at which the roughing rolling is performed or a short annealing of the "roughed bar" influence the recrystallization phenomena and favor the formation of homogeneous polycrystalline structure of the "roughed bar".

The second rolling stage is then performed by a "Finishing Mill", which transforms the recrystallized "roughed bar" to the desired "hot rolled strip" at final thickness.

A subject of the present invention is a process for the production of grain-oriented magnetic sheets, wherein a slab made of steel having a thickness of ≤100 mm, containing Si in the range comprised between 2.5 and 3.5% by weight, is subjected to a thermo-mechanical cycle comprising the following operations:

optional first heating to a temperature T1 no higher than 1250° C.

first rough hot-rolling, in a first rough hot rolling mill, to a temperature T2 comprised between 900 and 1200° C., the reduction ratio (% Rid) applied to the first rough hot-rolling being adjusted so as to be:

of at least 80%, in the absence of a subsequent heating to a temperature T3 determined by the following relationship $$\% \text{ Rid} = 80 - \frac{(T3 - T2)}{5},$$

in the presence of a subsequent heating to a temperature T3 optional second heating to a temperature T3>T2 second finishing hot-rolling, in a second finishing hot rolling mill, to a temperature T4<T3 to a thickness of the rolled section comprised in the range of 1.5 mm-3.0 mm cold-rolling, in one or more stages, with optional intermediate annealing, wherein in the last stage a cold reduction ratio no lower than 60% is applied primary recrystallisation annealing, optionally in a decarburizing atmosphere secondary recrystallisation annealing.

In the general case, the steel as used contains, in percent by weight, C 0.010-0.100, Si 2.5-3.5 and one ore more elements for forming inhibitors. The balance is Fe and unavoidable impurities.

In an embodiment of the present invention, the second heating to a temperature T3>T2 is implemented in time shorter than 60 s. To this purpose, for example, an electromagnetic induction heating station can be used which can be conveniently positioned so that the deformed material crosses it continuously from the output of the roughing mill to the access to the finishing mill.

In a variant of the present invention, the recrystallisation annealing of the strips resulting from the cold-rolling is carried out in nitriding atmosphere so as to increase the strips' nitrogen average content by a quantity comprised between 0.001 and 0.010%.

In another embodiment of the present invention, the steel slab to be subjected to a thermo-mechanical cycle has the following percent by weight composition:

C 0.010-0.100%;

Si 2.5-3.5%;

S+(32/79)Se 0.005-0.025%;

N 0.002-0.006%;

at least two of the elements in the series Al, Ti, V, Nb, Zr, B, W for an overall percent by weight no greater than 0.035%;

at least one of the elements in the series Mn, Cu, for an overall percent by weight no greater than 0.300%;

and optionally at least one of the elements in the series Sn, As, Sb, P, Bi, for an overall percent by weight no greater than 0.150%, the balance being Fe and unavoidable impurities.

Subject of the present invention is also a grain-oriented magnetic sheet obtainable with the process of the present invention exhibiting a microstructure wherein the volume of the metal matrix is at least 99% occupied by a distribution of crystalline grains individually crossing the entire thickness and having a shape ratio between the average diameter of the individual grains, measured on the rolled section plane, and the rolled section thickness greater than 10 and wherein the volume fraction occupied by grains with said shape factor lower than 10 is ≤1.0%.

By operating according to the indications of the present invention, even starting from cast products having thickness equal or smaller than 100 mm, typical of the Thin Slab technology, strongly recrystallised hot strips are obtained which, after cold-rolling at thicknesses comprised between 0.5 mm and 0.18 mm and continuously annealed at temperatures comprised between 800 and 900° C. to obtain a primary recrystallisation structure, have the grain structure characterized by a significantly reduced "DF" (driving force to the growth) parameter with respect to the case of the conventional processes.

Under the operating conditions described by the present invention, it is then possible obtaining with high industrial yields the control of the oriented secondary recrystallisation and consequently obtaining products with excellent magnetic characteristics, being able to avoid heating the cast slab before the hot-rolling or to implement heating temperatures of the cast material lower than 1200° C. and for this reason to solve also the problems of surface flaws deriving from the contact of the cast product surface with the transportation rollers of the heating furnace at temperatures higher than 1200° C.

The limits in the reduction ratio to be applied to the roughing, in the roughing temperatures and in the heating conditions to be adopted between the rough rolling and finishing rolling of the material to obtain the microstructure suitable for an industrial production of grain-oriented magnetic sheet with excellent magnetic properties and high manufacturing yields described in the present invention result from the records of a series of experiments carried out starting from alloys with silicon content of 2.5% and 3.5%. Tests consisted in hot-rolling cast materials having two different thicknesses (50 mm and 100 mm) under the conditions illustrated in Table A and Table B, wherein in the first column the test material (A25=alloy samples with 2.5% Si and A35=alloy samples with 3.5% Si) is identified and in the last column the thermal treatment temperature immediately subsequent to the rough hot rolling, when applied, is shown.

TABLE A

| TEST | Cast material thickness (mm) | Rough hot rolling temp. (° C.) | Thickness of rough hot rolled sections (mm) | % Def. | Heating temperature (° C.) |
|---|---|---|---|---|---|
| A25-1/5 | 50 | 1205 | 30 | 40 | no |
| A25-2/5 | 50 | 1190 | 20 | 60 | no |
| A25-3/5 | 50 | 1200 | 10 | 80 | no |
| A25-4/5 | 50 | 1200 | 26 | 48 | 1210 |
| A25-5/5 | 50 | 1195 | 12 | 76 | 1230 |
| A25-6/5 | 50 | 1202 | 10 | 80 | 1250 |
| A25-7/5 | 50 | 910 | 32 | 36 | no |
| A25-8/5 | 50 | 920 | 18 | 64 | no |
| A25-9/5 | 50 | 905 | 10 | 80 | no |
| A25-10/5 | 50 | 912 | 21 | 58 | 950 |
| A25-11/5 | 50 | 900 | 13 | 74 | 940 |
| A25-12/5 | 50 | 903 | 8 | 84 | 910 |
| A35-1/5 | 50 | 1180 | 28 | 44 | no |
| A35-2/5 | 50 | 1190 | 10 | 80 | no |
| A35-3/5 | 50 | 1175 | 8 | 84 | no |
| A35-4/5 | 50 | 1196 | 30 | 40 | 1250 |
| A35-5/5 | 50 | 1195 | 23 | 54 | 1240 |
| A35-6/5 | 50 | 1187 | 18 | 64 | 1230 |
| A35-7/5 | 50 | 910 | 25 | 50 | no |
| A35-8/5 | 50 | 920 | 20 | 60 | no |
| A35-9/5 | 50 | 905 | 10 | 80 | no |

TABLE A-continued

| TEST | Cast material thickness (mm) | Rough hot rolling temp. (° C.) | Thickness of rough hot rolled sections (mm) | % Def. | Heating temperature (° C.) |
|---|---|---|---|---|---|
| A35-10/5 | 50 | 912 | 25 | 50 | 950 |
| A35-11/5 | 50 | 900 | 18 | 64 | 1000 |
| A35-12/5 | 50 | 903 | 12 | 76 | 1040 |

(Rough hot rolling temperature = T2 and Heating temperature = T3)

TABLE B

| TEST | Cast material thickness (mm) | Rough hot rolling temp. (° C.) | Thickness of rough hot rolled sections (mm) | % Def. | Heating temperature (° C.) |
|---|---|---|---|---|---|
| A25-1/10 | 100 | 1195 | 42 | 58 | no |
| A25-2/10 | 100 | 1190 | 30 | 70 | no |
| A25-3/10 | 100 | 1205 | 18 | 82 | no |
| A25-4/10 | 100 | 1200 | 30 | 70 | 1220 |
| A25-5/10 | 100 | 1200 | 45 | 55 | 1235 |
| A25-6/10 | 100 | 1200 | 28 | 72 | 1250 |
| A25-7/10 | 100 | 900 | 33 | 67 | no |
| A25-8/10 | 100 | 910 | 20 | 80 | no |
| A25-9/10 | 100 | 900 | 16 | 84 | no |
| A25-10/10 | 100 | 910 | 37 | 63 | 930 |
| A25-11/10 | 100 | 905 | 28 | 72 | 940 |
| A25-12/10 | 100 | 900 | 19 | 81 | 950 |
| A35-1/10 | 100 | 1175 | 42 | 58 | no |
| A35-2/10 | 100 | 1190 | 30 | 70 | no |
| A35-3/10 | 100 | 1175 | 18 | 82 | no |
| A35-4/10 | 100 | 1190 | 30 | 70 | 1250 |
| A35-5/10 | 100 | 1185 | 45 | 55 | 1240 |
| A35-6/10 | 100 | 1200 | 28 | 72 | 1240 |
| A35-7/10 | 100 | 900 | 33 | 67 | no |
| A35-8/10 | 100 | 905 | 20 | 80 | no |
| A35-9/10 | 100 | 910 | 16 | 84 | no |
| A35-10/10 | 100 | 920 | 30 | 70 | 950 |
| A35-11/10 | 100 | 900 | 35 | 65 | 1000 |
| A35-12/10 | 100 | 910 | 45 | 55 | 1040 |

All test materials were hot-rolled to a thickness comprised between 2.10 mm and 2.25 mm. The so produced rolled sections are then cold-rolled in a single rolling stage to the nominal thickness of 0.30 mm. The cold rolled sections were then sampled and subjected in laboratory to an annealing treatment at 800° C. for 180 seconds in atmosphere containing hydrogen. From all produced samples metallographic sections were prepared for observation and characterization of the distribution of the recrystallised grain sizes. From the study for each produced material the value of the grains' average size and the distribution variance were obtained and with these data the "driving force" value to growth (DF) of the grains' distribution of each produced material were calculated.

The test results are synthetically collected in Table C.

All tests carried out according to the present invention allowed to obtain values of B800>1.9T (excellent magnetic characteristics) in all other cases products with adequate magnetic characteristics are not obtained.

The performed tests showed that by applying to the cast slabs having a thickness ≤100 mm a rough hot reduction greater or equal to 80%, the driving force to the grain growth of the cold rolled sections with final thickness after recrystallisation can be controlled and, consequently, also with the limited amount of inhibitors for the grain growth (fine particles of not metallic second phases) which can be managed starting from the thin slab industrial casting (direct rolling or heating in tunnel furnaces at the maximum Temperature of 1200-1250° C.), grain-oriented sheets with excellent magnetic characteristics are obtained. The performed tests show then that in case of applying a thermal treatment immediately subsequent to the rough hot rolling, products with excellent magnetic characteristics are obtained also with lower applied roughing deformations, up to a minimum of 60%, according to the claimed empiric rule connecting the ratio to be applied to the difference between the temperature of the rough hot rolling and the temperature of the subsequent heating.

TABLE C

| TEST | Coat material thickness (mm) | Rough hot rolling temp. (° C.) | Thickness of rough hot rolled sections (mm) | % Def. | Heating temperature (° C.) | Driving Force after recrystallisation (cm ⁻1) | B800 finished product (Tesla) |
|---|---|---|---|---|---|---|---|
| A25-1/5 | 50 | 1205 | 30 | 40.0 | no | 1.500 | 1,580 |
| A25-2/5 | 50 | 1190 | 20 | 60.0 | no | 1.111 | 1,640 |
| A25-3/5 | 50 | 1200 | 10 | 80.0 | no | 893 | 1,930 |
| A25-4/5 | 50 | 1200 | 26 | 48.0 | 1210 | 1.412 | 1,525 |
| A25-5/5 | 50 | 1195 | 12 | 76.0 | 1230 | 893 | 1,925 |
| A25-6/5 | 50 | 1202 | 10 | 80.0 | 1250 | 738 | 1,920 |
| A25-7/5 | 50 | 910 | 32 | 36.0 | no | 1.029 | 1,870 |
| A25-8/5 | 50 | 920 | 28 | 64.0 | no | 1.250 | 1,740 |
| A25-9/5 | 50 | 905 | 10 | 80.0 | no | 804 | 1,940 |
| A25-10/5 | 50 | 912 | 21 | 58.0 | 950 | 1.130 | 1,760 |
| A25-11/5 | 50 | 900 | 13 | 74.0 | 940 | 821 | 1,930 |
| A25-12/5 | 50 | 903 | 8 | 84.0 | 910 | 804 | 1,930 |
| A35-1/5 | 50 | 1180 | 28 | 44.0 | no | 1.500 | 1,540 |
| A35-2/5 | 50 | 1190 | 20 | 80.0 | no | 804 | 1,920 |
| A35-3/5 | 50 | 1175 | 8 | 84.0 | no | 739 | 1,930 |
| A35-4/5 | 50 | 1196 | 30 | 40.0 | 1250 | 1.330 | 1,540 |
| A35-5/5 | 50 | 1195 | 23 | 54.0 | 1240 | 1.190 | 1,560 |
| A35-6/5 | 50 | 1187 | 18 | 64.0 | 1230 | 1.091 | 1,620 |
| A35-7/5 | 50 | 910 | 25 | 50.0 | no | 1.778 | 1,560 |
| A35-8/5 | 50 | 920 | 26 | 60.0 | no | 1.296 | 1,510 |
| A35-9/5 | 50 | 905 | 10 | 80.0 | no | 1.010 | 1,910 |
| A35-10/5 | 50 | 912 | 25 | 50.0 | 950 | 1.250 | 1,730 |
| A35-11/5 | 50 | 900 | 18 | 64.0 | 1000 | 902 | 1,920 |
| A35-12/5 | 50 | 903 | 12 | 76.0 | 1040 | 659 | 1,910 |
| A25-1/10 | 100 | 1205 | 42 | 58.0 | no | 1.412 | 1,710 |
| A25-2/10 | 100 | 1190 | 30 | 70.0 | no | 1.556 | 1,680 |
| A25-3/10 | 100 | 1200 | 18 | 82.0 | no | 926 | 1,910 |
| A25-4/10 | 100 | 1200 | 30 | 70.0 | 1220 | 1.296 | 1,760 |
| A25-5/10 | 100 | 1195 | 45 | 55.0 | 1230 | 1.412 | 1,675 |
| A25-6/10 | 100 | 1202 | 28 | 72.0 | 1250 | 659 | 1,935 |
| A25-7/10 | 100 | 910 | 33 | 67.0 | no | 1.330 | 1,750 |
| A25-8/10 | 100 | 920 | 20 | 80.0 | no | 893 | 1,930 |
| A25-9/10 | 100 | 905 | 16 | 84.0 | no | 873 | 1,925 |
| A25-10/10 | 100 | 912 | 37 | 63.0 | 930 | 1.247 | 1,560 |
| A25-11/10 | 100 | 900 | 28 | 72.0 | 940 | 893 | 1,935 |
| A25-12/10 | 100 | 903 | 19 | 81.0 | 950 | 833 | 1,930 |
| A35-1/10 | 100 | 1180 | 42 | 58.0 | no | 1.250 | 1,540 |
| A35-2/10 | 100 | 1190 | 30 | 70.0 | no | 1.412 | 1,630 |
| A35-3/10 | 100 | 1175 | 18 | 82.0 | no | 926 | 1,940 |
| A35-4/10 | 100 | 1196 | 30 | 70.0 | 1250 | 902 | 1,900 |
| A35-5/10 | 100 | 1195 | 45 | 55.0 | 1240 | 1.286 | 1,550 |
| A35-6/10 | 100 | 1187 | 28 | 72.0 | 1230 | 659 | 1,930 |
| A35-7/10 | 100 | 910 | 33 | 67.0 | no | 2.317 | 1,790 |
| A35-8/10 | 100 | 920 | 20 | 80.0 | no | 804 | 1,910 |
| A35-9/10 | 100 | 905 | 16 | 84.0 | no | 833 | 1,930 |
| A35-10/10 | 100 | 912 | 30 | 70.0 | 950 | 1,875 | 1,520 |
| A35-111/10 | 100 | 900 | 35 | 65.0 | 1000 | 926 | 1,910 |
| A35-12/10 | 100 | 903 | 45 | 55.0 | 1040 | 833 | 1,910 |

A description of general character of the present invention has been given so far. With the help of the following examples, illustrating the invention and not limiting the scope of the same, a description of the embodiments thereof aimed at better understanding objects, advantages and application modes thereof will be now given.

EXAMPLE 1

A Fe-3.2% Si alloy containing C 0.035%, Mn 0.045%, Cu 0.018%, S+Se 0.018%, Al 0.012%, N 0.0051% was cast and solidified at a thickness of 62 mm with a solidification completion time of about 120 seconds. The material was then heated to a temperature of 1200° C. for 10 min and rough hot rolled to the temperature of 1150° C. with one single rolling pass to a thickness of 10 mm and then hot-rolled to a thickness of 2.3 mm in 5 deformation steps with an access temperature for the finishing rolling of 1050° C. The so obtained rolled section was conditioned by means of sand-blasting and pickling and cold-rolled at three different nominal thicknesses 0.30, 0.27 and 0.23 mm. The cold rolled sections were then subjected to a primary recrystallisation annealing and decarburization at 850° C. in atmosphere of H2/N2 (75%/25%) with pdr (dew point) 62° C., then coated with a MgO-based annealing separator and subjected to a secondary recrystallisation annealing in a static furnace up to 1210° C. The so produced product was characterized magnetically and the results are shown in table 1.

TABLE 1

| Test | Hot rolled section annealing | Cold-rolling 1 | Cold-rolling 2 | B800 (Tesla) | P17 (W/Kg) |
|---|---|---|---|---|---|
| A | No | 0.29 mm | No | 1.930 | 1.08 |
| B | No | 1.50 mm | 0.29 mm | 1.920 | 1.07 |
| C | Yes | 0.29 mm | No | 1.935 | 1.05 |
| D | No | 0.26 mm | No | 1.925 | 1.00 |
| E | No | 1.30 mm | 0.26 mm | 1.925 | 0.98 |
| F | Yes | 0.26 mm | No | 1.930 | 0.99 |
| G | No | 0.22 mm | No | 1.935 | 0.90 |
| H | No | 0.95 mm | 0.22 mm | 1.925 | 0.90 |
| I | Yes | 0.22 mm | No | 1.930 | 0.88 |

EXAMPLE 2

Hot strip samples having a thickness of 2.3 mm produced as in the previous experiment were rolled and transformed in laboratory according to the test shown in Table 2, wherein the "Hot rolled section annealing" column designates if a hot strip annealing consisting in a treatment of 1100° C. for 15 seconds in a Nitrogen atmosphere was made or not, in the Cold-rolling columns the thicknesses obtained with the lamination are shown. In case the cold-rolling was made in double stage, between the first and the second rolling the material was annealed at 900° C. for 40 seconds. After cold-rolling the final thickness, the materials were annealed in Hydrogen atmosphere at pdr 55° C., coated with a MgO-based annealing separator and then annealed up to 1200° C. for the secondary recrystallisation and elimination of Sulphur and Nitrogen. Table 2 shows the magnetic characteristics obtained in the single tests (P17 W/Kg represents the power losses at 1.7 Tesla and 50 Hertz).

TABLE 2

| Test | Hot rolled section annealing | Cold-rolling 1 | Cold-rolling 2 | B800 (Tesla) | P17 (W/Kg) |
|---|---|---|---|---|---|
| A | No | 0.29 mm | No | 1.930 | 1.08 |
| B | No | 1.50 mm | 0.29 mm | 1.920 | 1.07 |
| C | Si | 0.29 mm | No | 1.935 | 1.05 |
| D | No | 0.26 mm | No | 1.925 | 1.00 |
| E | No | 1.30 mm | 0.26 mm | 1.925 | 0.98 |
| F | Si | 0.26 mm | No | 1.930 | 0.99 |
| G | No | 0.22 mm | No | 1.935 | 0.90 |
| H | No | 0.95 mm | 0.22 mm | 1.925 | 0.90 |
| I | Si | 0.22 mm | No | 1.930 | 0.88 |

EXAMPLE 3

A Fe-3.2% Si aldloy containing C 0.0650%, Mn 0.050%, Cu 0.010%, S 0.015%, Al 0.015%, N 0.0042%, Sn 0.082 was solidified at a thickness of 70 mm in a continuous casting machine with a solidification completion time of about 230 seconds. The so cast material was then directly rough hot rolled in two hot deformation stages in quick sequence by implementing thermo-mechanical treatment conditions on different fractions of the cast thin slab so as to obtain rough hot rolled slabs with different thickness. The rough hot rolled slabs were then rolled to strip with nominal thickness of 2.1 mm. The hot rolled sections produced under the different conditions were then transformed, once the product was finished, according to a cycle comprising the following series of treatments: annealing at temperature of 1120° C. for 50 seconds, then cooling to 790° C. in air and subsequent hardening in water, cold-rolling to the thickness of 0.27 mm, primary recrystallisation annealing and decarburisation at 830° C. in atmosphere of H2/N2 (3/1) humidified at pdr 67° C., deposition of MgO-based annealing separator and final static secondary annealing at the maximum temperature of 1200° C. Then, the produced finished rolled sections were subjected to magnetic qualification at the frequency of 50 Hz. Table 3 shows the implemented test conditions and the obtained results.

TABLE 3

| Test | Thickness of the rough hot rolled slab (mm) | Reduction at roughing mill (%) | Exit temperature from roughing mill (° C.) | B800 (Tesla) | P17 (W/Kg) |
|---|---|---|---|---|---|
| A | 45 | 36 | 1200 | 1.580 | 2.27 |
| B | 34 | 51 | 1200 | 1.540 | 2.10 |
| C | 28 | 60 | 1150 | 1.780 | 1.46 |
| D | 14 | 80 | 1120 | 1.910 | 0.99 |
| E | 10 | 86 | 1115 | 1.930 | 0.94 |
| F | 7 | 90 | 1060 | 1.925 | 0.96 |

The produced sheets in the test were then qualified in terms of grain structure. The sheets produced with test A, B and C were characterized by the majority of the volume occupied by thickness passing crystalline grains having a shape factor F, defined as the relationship between the grains' average diameter on the plane and the size along the thickness, <10, whereas the sheets produced with test D, E and F show a thickness passing grain structure having individually the above-mentioned shape factor F>10 occupying entirely the volume of the metal matrix of the sheets (>99%).

EXAMPLE 4

A Fe-3.3% Si alloy containing C 0.0450%, Mn 0.050%, Cu 0.1%, S 0.023%, Al 0.015%, N 0.0055% was solidified at a thickness of 50 mm in a continuous casting machine with a solidification completion time of about 230 seconds. The so cast material was then directly rough hot rolled in two hot deformation stages in quick sequence by implementing different thermo-mechanical treatment conditions on different fractions of the cast thin slab so as to obtain rough hot rolled slabs with different thickness. The rough hot rolled slabs then passed through an induction heating furnace which was driven so as implement different conditions for the individual test pieces. Then, in sequence, the bars where strip rolled with nominal thickness of 2.5 mm. The hot rolled sections produced under the different conditions were then transformed, once the product was finished, according to a cycle comprising the following series of treatments: annealing to temperature of 1100° C. for 50 seconds, then cooling up to 800° C. in air and subsequent hardening in water, cold-rolling to the thickness of 0.27 mm, primary recrystallisation annealing and decarburisation at 830° C. in atmosphere of H2/N2 (3/1) humidified at pdr 62° C., deposition of a MgO-based annealing separator and final static secondary annealing at the maximum temperature of 1200° C. The produced finished rolled sections were subjected to magnetic qualification at the frequency of 50 Hz. Table 3 shows the implemented test conditions and the obtained results.

TABLE 4

| Test | Thickness of the rough hot rolled slab (mm) | Reduction at roughing mill (%) | Exit temperature from roughing mill (° C.) | Annealing temperature (° C.) | B800 (Tesla) |
|---|---|---|---|---|---|
| A1 | 20 | 60 | 1110 | off | 1.540 |
| B1 | 20 | 60 | 1090 | 1140 | 1.790 |
| C1 | 20 | 60 | 1100 | 1200 | 1.925 |
| D1 | 14 | 72 | 1060 | off | 1.580 |
| E1 | 14 | 72 | 1080 | 1130 | 1.930 |
| F1 | 14 | 72 | 1070 | 1150 | 1.935 |

Also in this case it was observed that in case of tests carried out according to the prescriptions of the following invention, that is for the tests C1, E1 and F1, the crystalline grains of the finished products have a shape factor F, defined in the example 3, >10, differently from the sheet grains of test A1 (F<10 for a volumetric fraction of 95%), of test B1 (F<10 for a volumetric fraction of 25%) and of test D1 (F<10 for a volumetric fraction of 80%)

EXAMPLE 5

A Fe-3.0% Si alloy containing C 0.0400%, Mn 0.045%, S 0.015%, Al 0.012%, N 0.0040% was solidified at a thickness of 50 mm in a continuous casting machine with a solidification completion time of about 230 seconds. The so cast material was then directly rough hot rolled in two hot deformation stages in quick sequence by implementing different thermomechanical treatment conditions on different fractions of the cast thin slab so as to obtain rough hot rolled slabs with different thickness. The rough hot rolled slabs then crossed an induction heating furnace which was driven so as implement different conditions for the individual test pieces. Then, in sequence, the bars where strip rolled with nominal thickness of 2.1 mm. The hot rolled sections produced under the different conditions were then transformed, once the product was finished, according to a cycle comprising the following series of treatments: annealing to temperature of 1100° C. for 50 seconds, cold-rolling to the thickness of 0.80 mm, intermediate recrystallisation annealing at 980° for 50 seconds, cold-rolling to the thickness of 0.23 mm, primary recrystallisation annealing and decarburisation at 830° C. in atmosphere of H2/N2 (3/1) humidified at pdr 60° C., deposition of a MgO-based annealing separator and final static secondary annealing at the maximum temperature of 1200° C. The produced finished rolled sections were subjected to magnetic qualification at the frequency of 50 Hz. Table 5 shows the implemented test conditions and the obtained results.

TABLE 5

| Test | Thickness of the rough hot rolled slab (mm) | Reduction at roughing mill (%) | Exit Temperature from Roughing Mill(° C.) | Annealing T (° C.) | B800 (Tesla) |
|---|---|---|---|---|---|
| A2 | 22 | 56 | 980 | off | 1.540 |
| B2 | 22 | 56 | 990 | 1030 | 1.680 |
| C2 | 22 | 56 | 980 | 1100 | 1.885 |
| D2 | 12 | 76 | 950 | off | 1.770 |
| E2 | 12 | 76 | 960 | 1000 | 1.885 |
| F2 | 12 | 76 | 950 | 1030 | 1.890 |

From observing the crystalline structure of the experiment products it was furthermore checked that in case of tests carried out according to the prescriptions of the following invention, that is for tests C2, E2 and F2, more than 99% of the volume of the metal matrix of the finished products is occupied by crystalline grain having a shape factor F, defined in example 3, >10, differently from the sheets of test A2 (F<10 for a volumetric fraction of 75%), of test B2 (F<10 for a volumetric fraction of 20%) and of test D2 (F<10 for a volumetric fraction of 15%).

EXAMPLE 6

A Fe-3.3% Si alloy containing C 0.0050%, Mn 0.048%, Cu 0.080%, S 0.019%, Al 0.028%, N 0.0035% was solidified at a thickness of 70 mm in continuous casting machine and the material directly rough hot rolled in two hot deformation stages in quick sequence to a thickness of 15 mm in the temperature range 1120-1090° C. and in continuous sequence, heated by means of an induction heating furnace at the temperature of 1150° C. Then, in sequence, the rough hot rolled material was rolled to the nominal thickness of 2.3 mm. The produced hot rolled sections were then transformed, once the product was finished, according to a cycle comprising the following series of treatments: annealing at temperature of 1120° C. for 40 seconds, then cooling up to 800° C. in air and subsequent hardening in water, cold-rolling to the thickness of 0.30 mm, continuous annealing with a first primary recrystallisation treatment at 870° C. for 90 seconds and in atmosphere of dry H2/N2 (1/1) and in sequence a secondary annealing treatment in atmosphere of humid H2/N2 (3/1), with pdr equal to 35° C. for 10 sec. For four processed strips, the atmosphere of the second treatment was modified by adding to the annealing atmosphere an ammonia concentration (NH3) varying from 2% and 7% in volume. The surface of all strips was coated with a MgO-based annealing separator and then subjected to final static annealing at the maximum temperature of 1210° C. The produced finished rolled sections were subjected to magnetic qualification at the frequency of 50 Hz. Table 6 shows the obtained results.

TABLE 6

| Test | Addition of NH3 second treatment | Nitrogen measured after treatment (%) | B800 (Tesla) | P17 (W/Kg) |
|---|---|---|---|---|
| A | No | 0.0035 | 1.920 | 1.05 |
| B | No | 0.0035 | 1.905 | 1.09 |
| C | No | 0.0035 | 1.925 | 0.98 |
| D | No | 0.0035 | 1.900 | 1.10 |
| E | Yes | 0.0135 | 1.925 | 0.98 |
| F | Yes | 0.0095 | 1.925 | 0.99 |
| G | Yes | 0.0070 | 1.925 | 0.97 |
| H | Yes | 0.0050 | 1.925 | 0.99 |

The test results show that, within the scope of the implementation of the process described with the present invention, upon increasing the Nitrogen amount of the strips by a quantity comprised in the range 0.001%-0.010% by means of nitriding before the thermal treatment of secondary recrystallisation, more stable and more constant magnetic characteristics are obtained.

The invention claimed is:

1. A process for the production of grain oriented magnetic sheets, wherein a slab made of steel having a thickness of ≤100 mm, containing Si in the range comprised between 2.5 and 3.5% by weight, is subjected to a thermomechanical cycle consisting of the following operations:

optional first heating, to a temperature T1 no higher than 1250° C.

first rough hot-rolling, in a first rough hot rolling mill, at a temperature T2 between 900 and 1200° C., the reduction ratio (% Rid) applied to the first rough hot-rolling being adjusted so as to be of at least 80%, in the absence of a subsequent heating to a temperature T3 of at least 60% determined by the following relationship $$\% \text{ Rid} = 80 - \frac{(T3 - T2)}{5}$$

in the presence of a subsequent heating to a temperature T3 lower than 1300° C., optional second heating, to a temperature T3>T2 second finishing hot-rolling, in a second finishing hot rolling mill, at a temperature T4<1300° C., to a thickness of the rolled section in the range of 1.5 mm-3.0 mm, cold-rolling, in one or more stages, with optional intermediate annealing, wherein in the last stage a cold reduction ratio no lower than 60% is applied primary recrystallisation annealing, optionally in a decarburizing atmosphere secondary recrystallisation annealing.

2. The process for the production of grain oriented magnetic sheets according to claim 1, wherein said second heating to a temperature T3>T2 is accomplished in less than 60 s.

3. The process for the production of grain oriented magnetic sheets according to claim 1, wherein the secondary recrystallisation annealing of the strips resulting from the cold-rolling is conducted in a nitriding atmosphere so as to increase average Nitrogen content of the strips of an amount comprised between 0.001 and 0.010%.

4. The process for the production of grain oriented magnetic sheets according to claim 2, wherein the steel slab to be subjected to the thermomechanical cycle has the following percent by weight composition:

C 0.010-0.100%;

Si 2.5-3.5%;

S+(32/79)Se 0.005-0.025%;

N 0.002-0.006%;

at least two of the elements in the series Al, Ti, V, Nb, Zr, B, W, for an overall percent by weight no greater than 0.035%;

at least one of the elements in the series Mn, Cu, for an overall percent by weight no greater than 0.300%;

and optionally at least one of the elements in the series Sn, As, Sb, P, Bi, for an overall percent by weight no greater than 0.150%, the balance being Fe and unavoidable impurities.

* * * * *